US008739704B2

(12) United States Patent
Wickman et al.

(10) Patent No.: US 8,739,704 B2
(45) Date of Patent: Jun. 3, 2014

(54) RAILROAD TIE HARDWARE REMOVING APPARATUS AND METHODS

(75) Inventors: Dean T. Wickman, Quinnesec, MI (US); Steven L. Benck, North Barrington, IL (US); Dennis Hanke, Algonquin, IL (US)

(73) Assignee: Rail Construction Equipment Company, Rockford, IL (US)

( * ) Notice: Subject to any disclaimer, the term of this patent is extended or adjusted under 35 U.S.C. 154(b) by 248 days.

(21) Appl. No.: 13/154,932

(22) Filed: Jun. 7, 2011

(65) Prior Publication Data

US 2011/0297034 A1 Dec. 8, 2011

Related U.S. Application Data

(60) Provisional application No. 61/352,226, filed on Jun. 7, 2010.

(51) Int. Cl.
*E01B 29/24* (2006.01)

(52) U.S. Cl.
USPC ..... 104/9; 104/2

(58) Field of Classification Search
USPC ..... 104/2, 9, 12, 16, 17.2
See application file for complete search history.

(56) References Cited

U.S. PATENT DOCUMENTS

| | | | | |
|---|---|---|---|---|
| 3,881,422 | A | 5/1975 | Bryan, Jr. | |
| 3,883,118 | A * | 5/1975 | Miller | 254/18 |
| 4,096,806 | A | 6/1978 | Allmer | |
| 4,538,793 | A | 9/1985 | Dieringer et al. | |
| 4,746,553 | A | 5/1988 | Crisafulli | |
| 5,586,502 | A * | 12/1996 | Weber | 104/17.2 |
| 5,758,821 | A * | 6/1998 | Wirthwein et al. | 238/366 |
| 7,258,069 | B1 * | 8/2007 | Cotsford | 104/7.1 |
| 7,574,961 | B2 * | 8/2009 | Barezzani et al. | 104/17.2 |
| 7,677,177 | B2 * | 3/2010 | Ganz | 104/17.2 |

* cited by examiner

*Primary Examiner* — Zachary Kuhfuss
(74) *Attorney, Agent, or Firm* — Reinhart Boerner Van Deuren P.C.

(57) ABSTRACT

A railroad tie hardware removing apparatus and methods are provided. The apparatus includes one or more tool mechanisms each carrying one or more tools. The tools are positionable relative to a mounting structure or tower of a concrete railroad tie to remove the tower therefrom. Once the towers are removed, the tie can be pulled from underneath rails supported by the tie.

15 Claims, 8 Drawing Sheets

RAILROAD TIE HARDWARE REMOVING APPARATUS AND METHODS

CROSS-REFERENCE TO RELATED PATENT APPLICATIONS

This patent application claims the benefit of U.S. Provisional Patent Application No. 61/352,226 filed on Jun. 7, 2010, the entire teachings and disclosure of which are incorporated herein by reference thereto.

FIELD OF THE INVENTION

This invention generally relates to railroad construction equipment and specifically to railroad construction equipment configured for the maintenance and replacement of concrete railroad ties.

BACKGROUND OF THE INVENTION

Concrete railroad ties are generally considered to be a superior alternative to their wooden counterparts. While having the same general shape and performing the same general function as a wooden tie, concrete ties generally have a longer operational life, and additionally provide greater support for high speed and heavy traffic rails than wooden railroad ties. As a result, there is a growing use of concrete ties in the industry in the replacement of wooden ties, and in the construction of new rail lines.

Despite the above advantages, concrete ties can become unserviceable over time and need to be replaced. Replacing concrete ties is somewhat similar to replacing wooden ties in that the tie is pulled from underneath the rails of the railroad track along a direction generally perpendicular to the rails.

However, replacing spent concrete ties can be time consuming and labor intensive. The difficulty in replacing concrete railroad ties is due in large part to the fastening system used to fasten the railroad tracks to the tie. Generally, concrete railroad ties include mounting structures used to fix the rails to the tie. Such hardware typically include metal lugs or fasteners (hereinafter referred to as "towers") that are cast into the concrete and have an exposed portion that extends above a top surface of the concrete tie. The typical overall height of a concrete tie is therefore generally greater than a wooden tie due to the additional height of the exposed portion of the towers.

The towers are used in conjunction with clips to fasten the railroad tracks to the tie to prevent unwanted movement of the railroad tracks relative thereto. Typically, a tower is located on either side of a single railroad track so that clips can be mounted to the tower and installed in such a way that they exert an even downward pressure on the rail thereby forcing it against the concrete tie. Unfortunately, removing a concrete tie from underneath the railroad tracks to replace it with a new tie is very difficult because the towers will interfere with the railroad tracks if the tie is pulled in a direction generally perpendicular to the rails.

Generally, it is undesirable and in some cases impossible to "lift" the rail from the tie or ties to be replaced to allow clearance for the additional height of the tie created by the towers, as such an operation can permanently deform the rail. Instead, and with reference to FIG. 9, to remove a concrete tie from underneath the rail, a trench 308 must be dug adjacent to the tie 310 that is deep enough to accommodate the overall height of the tie 310, including the exposed portions of the towers 322, so that the tie 310 can be removed from underneath the rails 312 of the railroad tracks without disturbing them.

Accordingly, the general process of removing a concrete railroad tie to replace the same requires first manually removing the clips. Then, a trench is dug adjacent to the tie. The tie is then pushed or otherwise forced into the trench. Finally, the concrete tie is pulled from under the tracks. When hundreds and/or thousands of concrete ties must be replaced along a single rail line in a single job, the above order of operations can drive the cost of replacement to undesirable, and in extreme cases economically infeasible, levels.

In view of the above, it is desirable to have an apparatus and method for replacing a concrete railroad tie that alleviates the deficiencies noted above.

Embodiments of the invention provide such an apparatus and method. These and other advantages of the invention, as well as additional inventive features, will be apparent from the description of the invention provided herein.

BRIEF SUMMARY OF THE INVENTION

In one aspect, embodiments of the invention provide a railroad tie hardware removing apparatus for removing mounting structures used to affix the rails of a railroad track to a concrete railroad tie. An embodiment of the railroad tie hardware removing apparatus according to this aspect includes a frame configured for travel upon the rails of the railroad track. The apparatus also includes at least one tool adapted to break the mounting structure free from the concrete railroad tie. At least one tool mechanism is mounted to the frame. The at least one tool is carried by the at least one tool mechanism. The at least one tool mechanism is operable to transition the at least one tool from a stored position wherein the at least one tool is spaced above the mounting structures and a working position wherein the at least one tool is in contact with one of the mounting structures.

In certain embodiments, the frame includes rail wheels such that the frame is movable along the rails via the wheels.

In certain embodiments, the at least one tool mechanism includes a first and a second tool arm. The at least one tool includes a first and a second tool carried, respectively, by the first and second tool arms. The first and second tool arms are mechanically coupled at a first common mounting point to a mounting hub. The first and second tool arms are mechanically coupled to one another by a scissor mechanism.

In certain embodiments, the scissor mechanism includes a first scissor linkage connected at a first end thereof to the first tool arm, and a second scissor linkage connected at a first end thereof to the second tool arm. Each of the first and second scissor mechanisms have second ends that are commonly mounted at a second common mounting point.

In certain embodiments, the second common mounting point is an end of a linear actuator. The linear actuator is connected to a frame of the at least one tool mechanism at an end of the linear actuator opposite the end of the actuator providing the second common mounting point.

In certain embodiments, extension of the linear actuator moves the first and second tools from the stored position to the working position. In certain embodiments, extension of the linear actuator moves the first and second tool arms simultaneously from the stored position to the working position and laterally away from one another.

In certain embodiments, a longitudinal axis of the at least one tool is at an angle of about 45° relative to the rails in the working position. In certain embodiments, the longitudinal axis of the at least one tool is at an angle of about 45° relative to a top surface of the concrete railroad tie in the working position.

In another aspect, a railroad tie hardware removing apparatus configured for travel upon a pair of rails of a railroad track and configured for removing mounting structures used to affix the repair of rails of the railroad track to a concrete railroad tie is provided. A railroad tie hardware removing apparatus according to this embodiment includes a frame having at least a pair of wheels configured for rolling translation upon the pair of rails. The apparatus also includes a first tool mechanism mounted to the frame. The first tool mechanism has a first linear actuator operably connected to a first scissor mechanism to simultaneously transition first and second tools carried by the first tool mechanism from a stored position to a working position. In the working position, the first and second tools each contact mounting structures of the railroad track. The apparatus also includes a second tool mechanism mounted to the frame. The second tool mechanism has a second linear actuator operably connected to a second scissor mechanism to simultaneously transition third and fourth tools carried by the second tool mechanism from a stored position to a working position. In the working position, the third and fourth tools each contact mounting structures of the railroad track. The apparatus also includes a power source for supplying power to the first and second linear actuators. A controller is also provided that is operably connected between the power source and the first and second linear actuators to selectively direct power to each of the first and second linear actuators.

In certain embodiments, the controller is operably connected between the power source and the first and second linear actuators such that the first linear actuator is movable independently from the second linear actuator and vice versa.

In certain embodiments, the power source is a hydraulic power source. In certain embodiments, the hydraulic power source is a stand alone power source carried by the frame. In certain other embodiments, the hydraulic power source is a hydraulic power source of a piece of heavy equipment.

In yet another aspect, a method for removing a mounting structure used to affix a pair of rails of a railroad track to a concrete railroad tie is provided. An embodiment of the method according to this aspect includes positioning a frame carrying at least one tool mechanism over the mounting structure. The method also includes extending at least one tool carried by the at least one tool mechanism from a stored position to a working position. In the working position, the at least one tool contacts the mounting structure. The method also includes removing the mounting structure from the concrete railroad tie by applying a force against the mounting structure at a selected orientation using the tool.

In certain embodiments, positioning includes rolling the frame along the pair of rails using at least one pair of rail wheels mounted to the frame.

In certain embodiments, extending includes simultaneously extending first and second tools connected to one another and to a linear actuator using a scissor mechanism.

In certain embodiments, removing the mounting structure includes applying a force at a selected orientation comprising an angle of about 45° between a longitudinal axis of the at least one tool and the pair of rails.

In certain embodiments, removing the mounting structure includes applying a force at a selected orientation comprising an angle of about 45° between the longitudinal axis of the at least one tool and a top surface of the concrete railroad tie.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
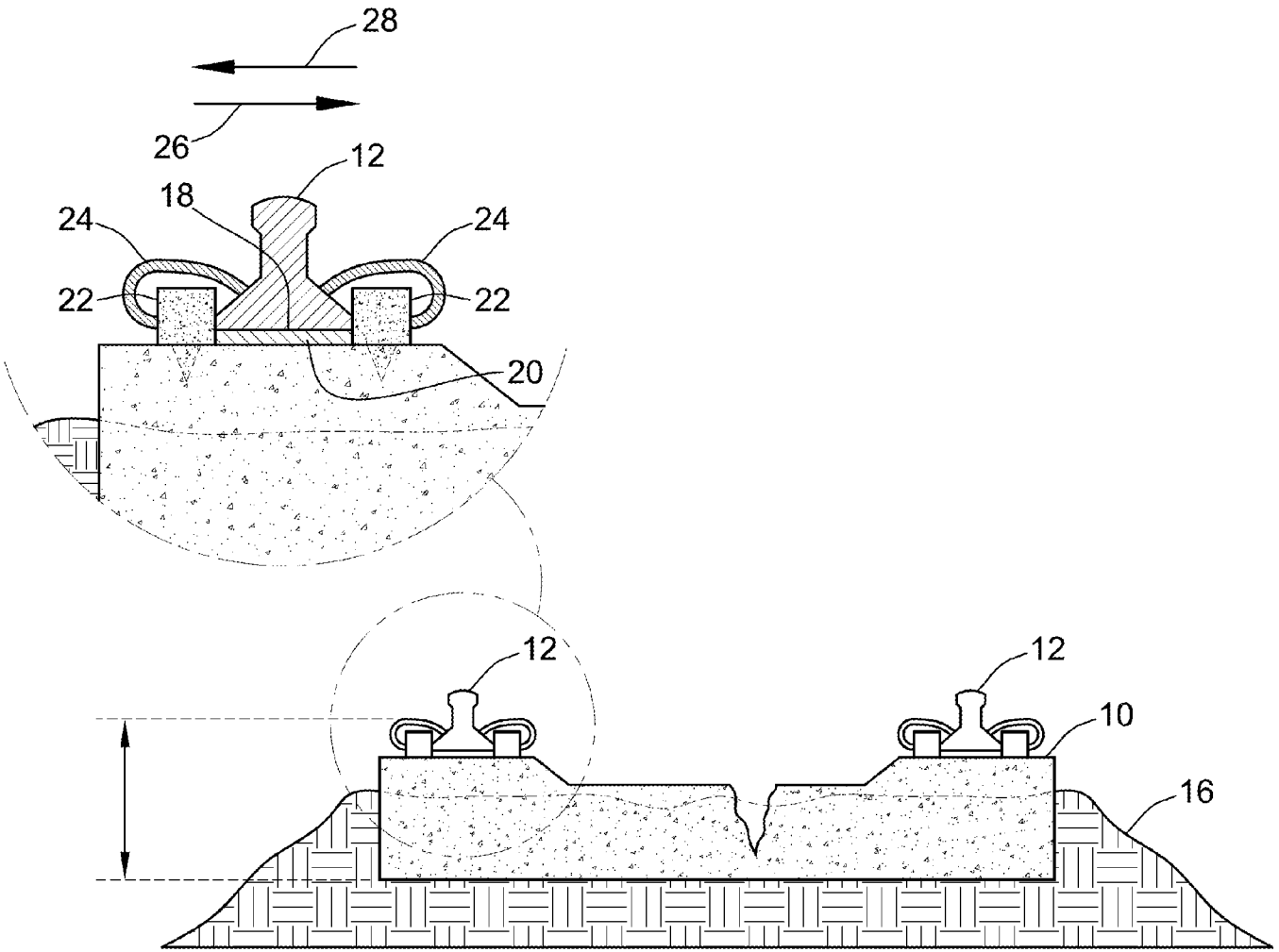
FIG. 1 is a front partial cross section of a concrete railroad tie situated in a ballast and carrying rails of railroad track.

Turning now to the drawings, a concrete railroad tie 10 is illustrated in FIG. 1 with a pair of rails 12 of a railroad track mounted thereon. The railroad tie 10 is partially buried in a section of soil commonly referred to as a ballast 16. Each one of the rails 12 are fixed to the railroad tie 10 using a pair of towers 22 and a pair of clips 24. A pad 20 can also be included under the rails 12, and above the tie 10 to pad the contact therebetween.

The clips 24 are removably attachable to the towers 22 to fixedly retain the rails 12 relative to the railroad tie 10. Each tower 22 and clip 24 is situated on either side of the rail 12. The towers 22 extend beyond a bottom surface 18 of the rail 12. As a result, when the clips 24 are removed from the towers 22, the tie 10 is nonetheless prevented from moving in directions 26, 28 as the towers 22 will generally interfere with the rail 12.

Figure 9:
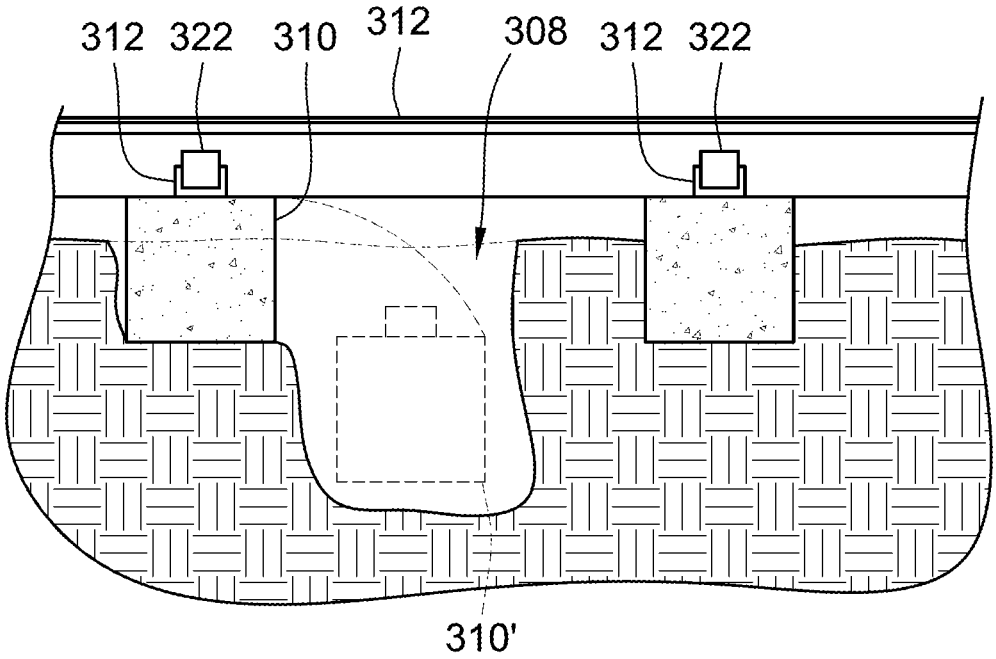
FIG. 9 (PRIOR ART)
FIG. 9 is a partial side view of a prior art configuration for removing a concrete railroad tie from under a pair of rails of a railroad track.

To avoid the problems of digging an additional trench as discussed above relative to FIG. 9 (see trench 308), embodiments of the present invention provide an apparatus and method for removing the towers 22 with the tie 10 in place, by breaking the towers 22 from the tie 10. This will allow the tie 10 to move relative to the rails 12 in either of directions 26, 28 without interfering with the rails 12. Because there is no interference once the towers 22 are removed and the tie 10 can therefore move in directions 26, 28, an additional trench as discussed above is not required.

Figure 2:
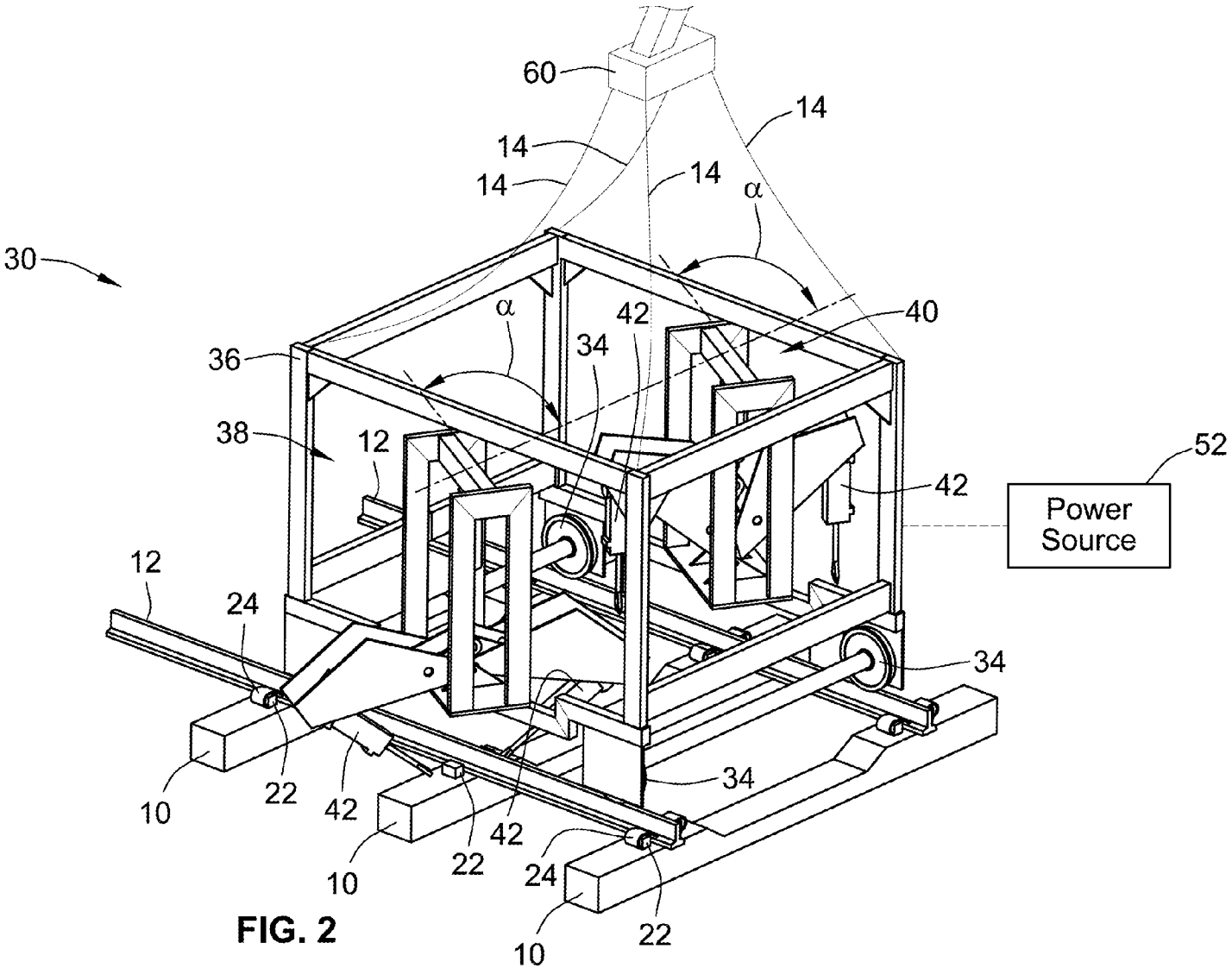
FIG. 2 is a perspective view of an exemplary embodiment of a tower removing apparatus according to the teachings of the present invention.

Turning now to FIG. 2, an exemplary embodiment of a tower removing apparatus is illustrated in the form of a tower removing attachment 30. The tower removing attachment 30 is designed to connect to the arm 60 of an excavator or other piece of heavy equipment (not shown), and draw hydraulic and electrical power from the power source 52 of the excavator.

The tower removing attachment 30 includes at least one pair of wheels 34 allowing the same to move along the rails 12 of a railroad track. In the illustrated embodiment, the tower removing attachment 30 includes a first and a second pair of wheels 34. As the excavator and its associated arm 60 move adjacent to the railroad track, the tower removing attachment 30 will move along the rails. The aforementioned movement allows the tower removing attachment 30 to be easily positioned relative to a particular one or several concrete railroad ties 10 from which the towers 22 will be removed, through movement of the associated arm 60 and equipment providing the arm 60. The tower removing attachment 30 is illustrated as connected to the arm 60 via chains 14 as schematically illustrated, however, those skilled in the art will recognize that other connections are possible, such as rigid connections.

Further, in the illustrated embodiment, the arm 60 is connected to a piece of heavy equipment that travels adjacent to the rails 12 of the railroad track, i.e. an "off-track" vehicle. However, in other embodiments, the tower removing attachment 30 can be connected to an arm of a piece of heavy equipment designed to travel directly on the rails 12, i.e. an "on-track" vehicle, such as a high rail excavator as shown and described in U.S. patent application Ser. No. 12/844,610, which is assigned to the instant assignee and the teachings and disclosure of which are herein incorporated by reference thereto. Yet further, the tower removing attachment 30 need not be connected to an arm 60, but instead could be towed by the aforementioned high rail excavator, or another dissimilar piece of equipment.

Additionally, and as an alternative to being provided in the form of an attachment, the tower removing apparatus can be in the form of a tower removing vehicle (not shown) that can include a stand alone drive mechanism and associated controls, as well as a stand alone power source or source and achieve the same advantages as described herein.

Turning now to the particular structural attributes of the tower removing attachment 30 illustrated in FIG. 2, the tower removing attachment 30 includes a frame 36, a pair of tool mechanisms 38, 40 carried by the frame 36. Each tool mechanism 38, 40 includes a pair of tools 42 used to physically break the towers 22 from the ties 10. The frame 36, tool mechanisms 38, 40, and operation of the tools 42 are described in turn below.

With regard to the frame 36, the same is generally a box-like skeletal structure. The frame 36 includes wheels 34 as introduced above to allow the frame to roll upon the rails 12 of a railroad track. One pair of wheels 34 are connected via an axle at one end of the frame 36, while another pair of wheels 34 are connected via an axle at the other end of the frame 36. The frame 36 is generally open in its interior and areas between the structural members thereof to allow for the movement of the tool mechanisms 38, 40 as described below. The frame 36 can be manufactured from hollow core, or solid, metal structural members made of steel or other materials strong enough to support the tool mechanisms 38, 40.

Figure 3:
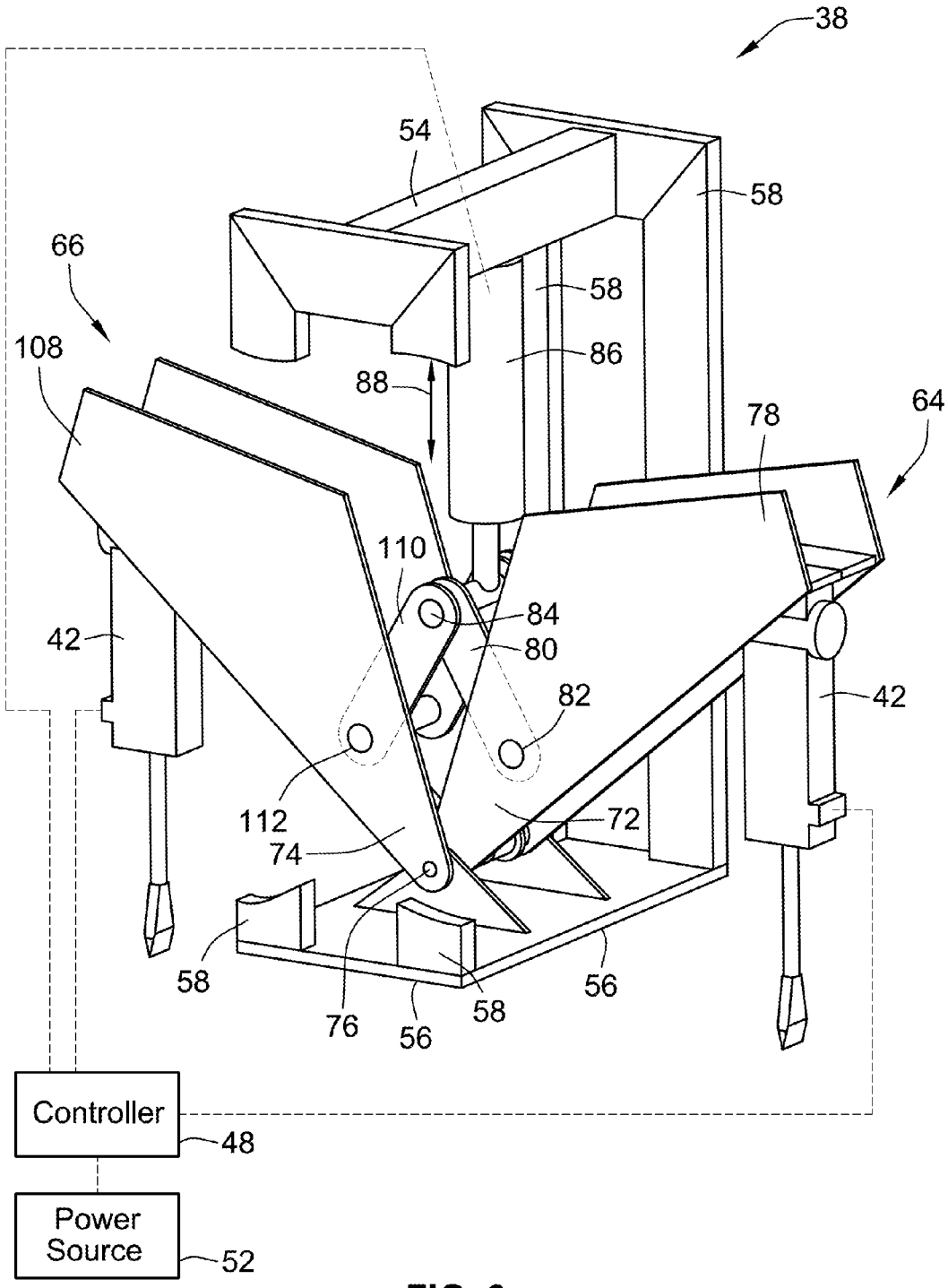
FIG. 3 is a perspective view of a tool mechanism of the tower removing apparatus of FIG. 2.

Turning now to FIG. 3, the structural configuration and operation of the tool mechanisms 38, 40 will be described in greater detail. The tool mechanisms 38, 40 are identical, therefore only one tool mechanism 38 will be described in greater detail to avoid redundancy. The tool mechanism 38 shown at FIG. 3 includes an upper support 54, a lower support 56, and a plurality of support members 58 extending between the upper and lower supports 54, 56. A pair of tool arms 64, 66 are mounted at their respective first ends 72, 74 at a common mounting point provided by a mounting hub 76 extending from the lower plate 56. For purposes of description, the right-most tool arm 64 will be referred to as the right tool arm 64, and the left-most tool arm 66 will be referred to as the left tool arm.

The right tool arm 64 carries a tool 42 such as a hydraulic hammer mounted at a second end 78 of the right tool arm 64. Although generally illustrated as a hydraulic hammer, those skilled in the art will recognize from the disclosure herein that other tools such as electrically powered hammers or the like could also be used. Further, it is contemplate that other non-hammering type tools could also be utilized such as saws, torches, grinders, etc.

The tool 42 is fixedly mounted to the second end 78 such that the right tool arm 64 and tool 42 maintain a fixed angle relative to one another. An end of a scissor linkage 80 is mounted at an intermediary mounting point 82 of the right tool arm 64 via a pin type connection, allowing the scissor linkage 80 to rotate relative to the right tool arm. At an opposite end thereof, the scissor linkage 80 is mounted to an end 84 of a linear actuator 86. As will be explained in greater detail below, the end 84 of the linear actuator also serves as a common mounting point between the scissor linkage 80 of the right tool arm 64, and a scissor linkage 110 of the left tool arm 66. The linear actuator 86 can be electric or hydraulic, with a hydraulic embodiment being illustrated herein.

The left tool arm 66 and its associated mechanical interconnections are generally a mirror image of the right tool arm 64 and its associated mechanical interconnections described above.

More specifically, the left tool arm 66 also carries a tool 42 in the form of a hydraulic hammer mounted at a second end 108 of the left tool arm 64. The tool 42 is fixedly mounted to the second end 108 such that the left tool arm 66 and tool 42 maintain a fixed angle relative to one another. An end of a scissor linkage 110 is mounted at an intermediary mounting point 112 of the left tool arm 66 via a pin type connection, allowing the scissor linkage 110 to rotate relative to the right tool arm. At an opposite end thereof, the scissor linkage 110 is mounted to the end 84 of the linear actuator 86.

Figure 4:
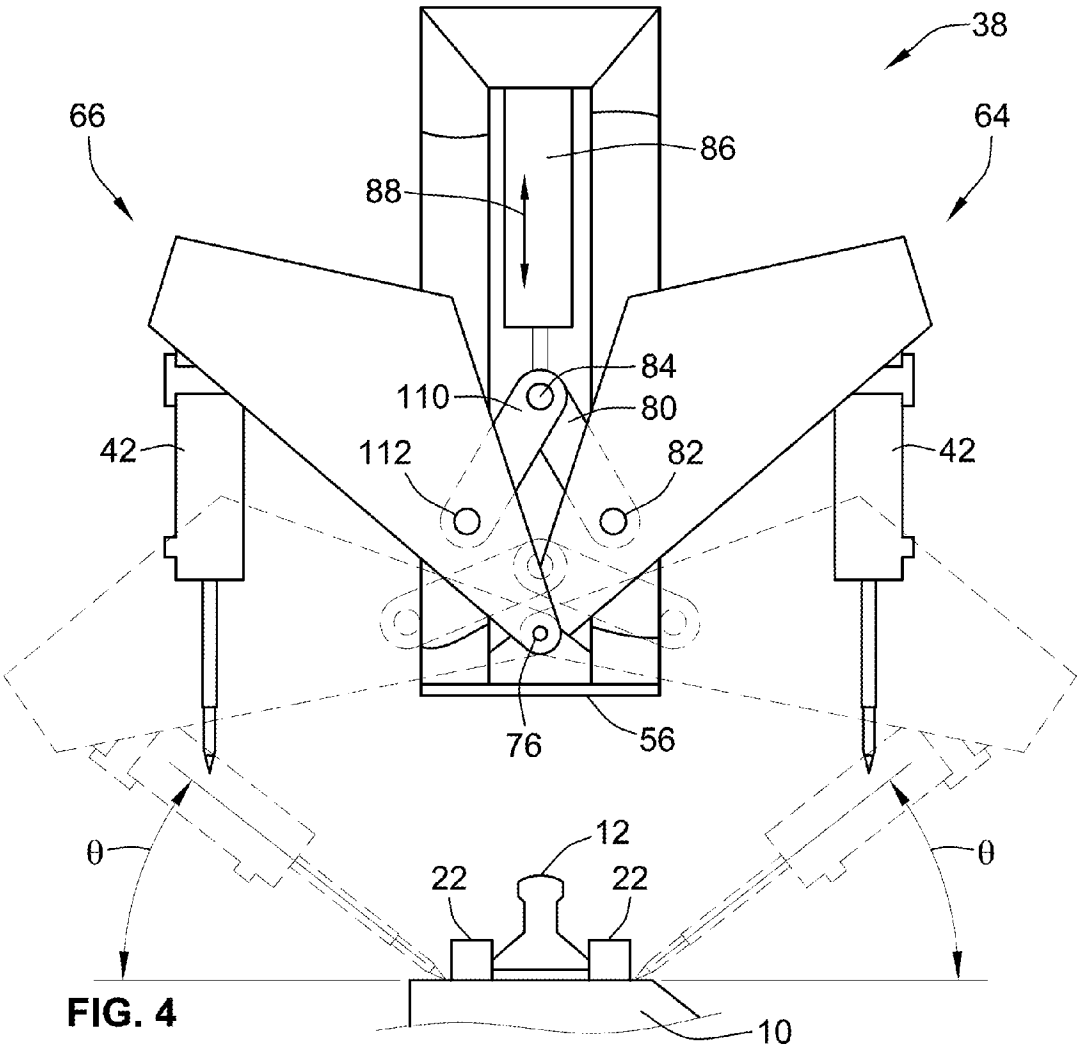
FIG. 4 is a front view of a tool mechanism of the tower removing apparatus of FIG. 3.

Turning now to FIG. 4, linear movement of the linear actuator 86 downward and in direction 88 causes the angle between the scissor linkage 80 and the right tool arm 64 to decrease, and the right tool arm 64 to rotate about the common mounting point provided by mounting hub 76. This operation transitions the tool 42 from a stored position, wherein the tool 42 is positioned above and away from the tower 22 that will be removed, to a working position (shown in dashed lines), wherein the tool 42 is positioned in close proximity to the tower 22 that will be removed.

Likewise, linear movement of the linear actuator 84 in direction 88 causes the angle between the scissor linkage 110 and the left tool arm 66 to decrease, and the left tool arm 66 to rotate about the common mounting point provided by mounting hub 76. This operation transitions the tool 42 from a stored position, wherein the tool 42 is positioned above and away from the tower 22 that will be removed, to a working position, wherein the tool 42 is positioned in close proximity to the tower 22 that will be removed.

The movement of the right and left tool arms 64, 66 described above occurs simultaneously and is mechanically synchronized by way of the common connection of the scissor linkages 80, 110 to the end 84 of the linear actuator 86, and by way of the common connection of the right and left tool arms 64, 66 to the common mounting point of the mounting hub 76. As such, each tool mechanism 38, 40 can be generally classified as a scissor type mechanism.

With momentary reference back to FIG. 3, the tools 42 and linear actuators of each tool mechanism 38, 40 are connected via conduit 46 to a power controller 48. The power controller 48 is connected to a power system such as the power source 52 also as shown at FIG. 3. As described above, the power source 52 can be a stand alone hydraulic and electrical power system, or it can be the hydraulic and electrical power system of the heavy equipment the tower removing attachment 30 is connected to. The power controller 48 can be embodied as a diverter type arrangement to selectively direct fluid power to one or both of the tool mechanisms 38, 40. As a result, each tool mechanism 38, 40 is capable of independent actuation from the other.

The power controller 48 governs the distribution of power to the tools 42 to ensure that the tools 42 have enough power to remove the towers 22. Although illustrated as incorporating a single power controller 48, it is recognized that the tools 42 may independently connect to multiple power controllers 48. Additionally, the power controller 48 may be mounted locally on the tower removing attachment 30 (see FIG. 1) or remotely on the piece of equipment incorporating the same.

Turning back to FIG. 4, when positioning the tools 42 relative to the towers 22, it is advantageous to align the tools 42 in such a way that the towers 22 are completely or substantially removed from the tie 10 when the tools 42 apply a sufficient force. Otherwise, additional grinding will be necessary to ensure that the towers 22 do not interfere with the rail 12 during removal.

As illustrated in FIG. 4, the tools 42 of tool mechanism 38 are aligned with adjacent towers 22 in the working position (shown in dashed lines). As described below, the tools 42 remove the towers 22 by directing a successive hammering force against the towers 22 to break them free from the tie 10. To ensure that the towers 22 are completely removed from the tie 10, each tool 42 has a selected orientation relative to its associated tower 22.

Figure 5:
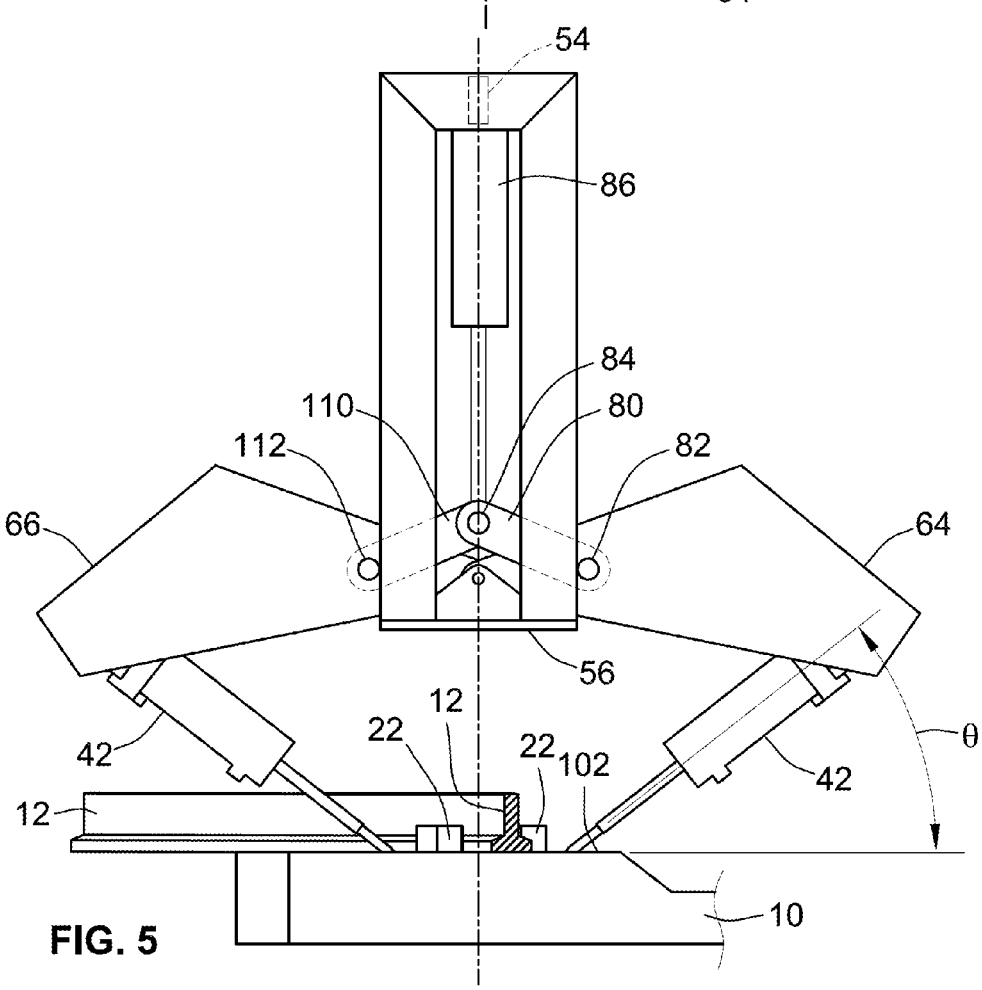
FIG. 5 is a partial front view of a pair of tools of the tool mechanism of FIG. 4 aligned with the tie at an angle θ.

With reference to FIG. 5, when viewing the tie 10 from the front, a longitudinal axis of each tool 42 is generally aligned relative to a top surface 102 of the tie 10 at an angle θ (see also FIG. 4). In the illustrated embodiment, the angle θ falls within a range of between about 10° and 70°, and more preferably within a range of between about 20° to about 60°, and even more preferably within a range of between about 25° to about 50°. In the illustrated embodiment, the angle θ is about 45°. The aforementioned angles have been found to significantly increase the ability to entirely break the towers 22 free, without leaving a portion of the towers 22 in place.

Figure 6:
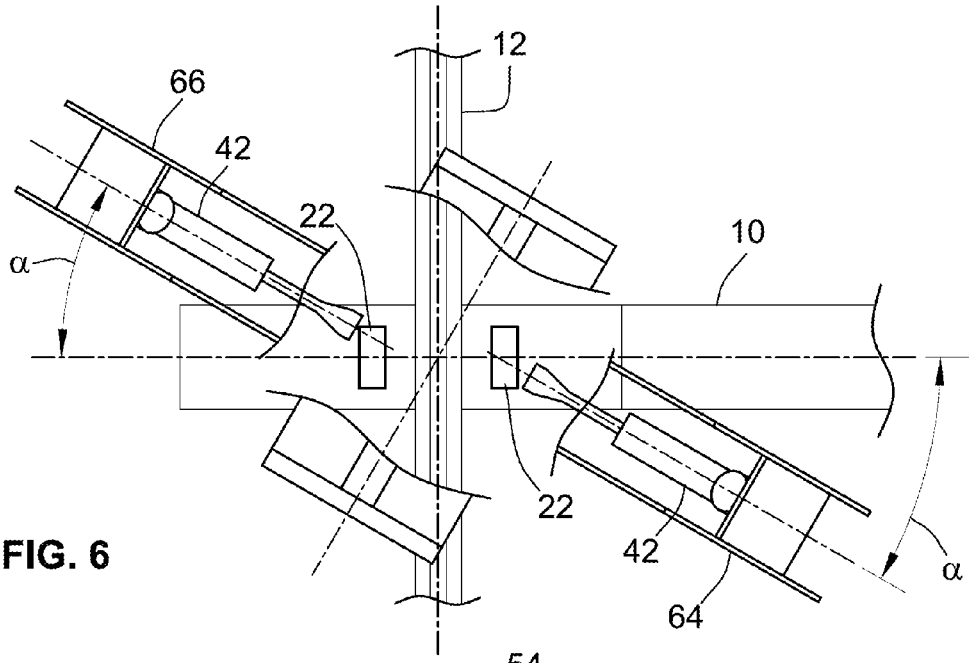
FIG. 6 is a partial top view of a pair of tools of the too mechanism of FIG. 4 aligned with the tie at an angle α.

With reference to FIG. 6, when viewing the top surface of the tie 10, a longitudinal axis of each tool 42 is aligned relative to a longitudinal axis of the rail 12 at an angle α. In the illustrated embodiment, the angle α falls within a range of between about 10° and 70°, and more preferably within a range of between about 20° to about 60°, and even more preferably within a range of between about 25° to about 50°. In the illustrated embodiment, the angle α is about 35°. The aforementioned angles have been found to significantly increase the ability to entirely break the towers 22 free, without leaving a portion of the towers 22 in place.

With momentary reference back to FIG. 2, the particular orientation of the tools 42 relative to the tie 10 and rail 12 is of significance as described above. As a result, each tool mechanism 38, 40 is fixedly mounted relative to the frame 36 such that the angle α described above relative to FIG. 6 is generally preset and always maintained by virtue of the fixed angular orientation of the tool mechanisms 38, 40 relative to the frame 36. Further, and because the motion of each tool mechanism 38, 40 is planar when moving from the stored to the working position, such movement has no effect on the angle α between the rail 12 and each tool 42.

Further, the angle between the tools 42 and their associated tool arms (tool arms 64, 66 in the case of tool mechanism 38 shown at FIG. 3) is generally fixed as well. As a result, a known amount of travel of the linear actuator of each tool mechanism 38, 40 will achieve the desired angle θ between each tool 42 and the tie 10 as described above relative to FIG. 4.

Figure 7:
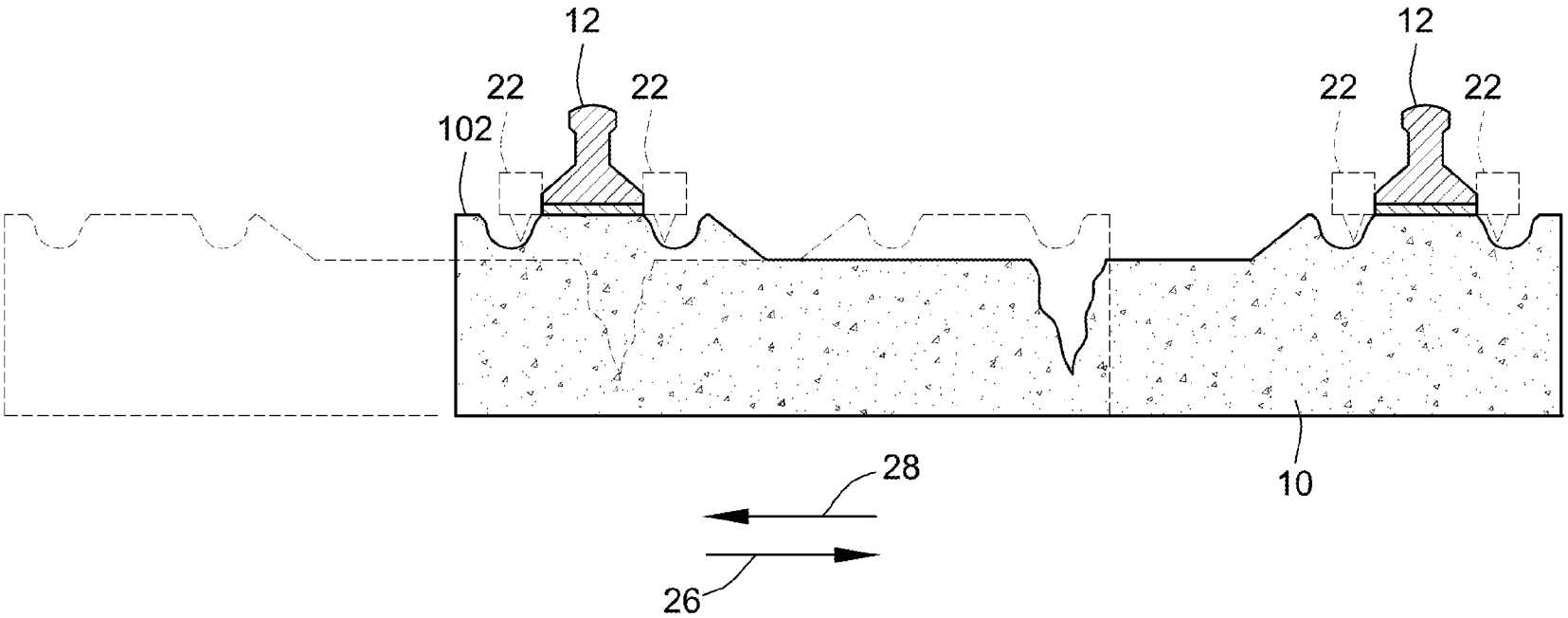
FIG. 7 is a front view of the concrete tie of FIG. 1 with the towers removed.

Turning now to FIG. 7, the tie 10 is illustrated with the towers 22 removed, leaving areas of partially removed concrete in the locations 70 where the towers 22 were previously located. From examination of FIG. 7, it will be recognized that the tie 10 may now be freely removed from underneath the rails 12 along either of directions 26 or 28 without interference.

Additionally, it will be recognized that, depending on which direction 26, 28 the tie 10 will be pulled along, the leading tower 22 need not be removed as there is no risk of interference therefrom. With reference to FIG. 7, if the tie 10 will be pulled along direction 26, then the right most tower 22 need not be removed. Similarly, if the tie 10 will be pulled along direction 28, then the left most tower 22 need not be removed.

Having discussed the general structural attributes of an exemplary embodiment of a tower removing attachment 30, the remainder of the description will focus on the general process of removing the towers 22.

Figure 8:
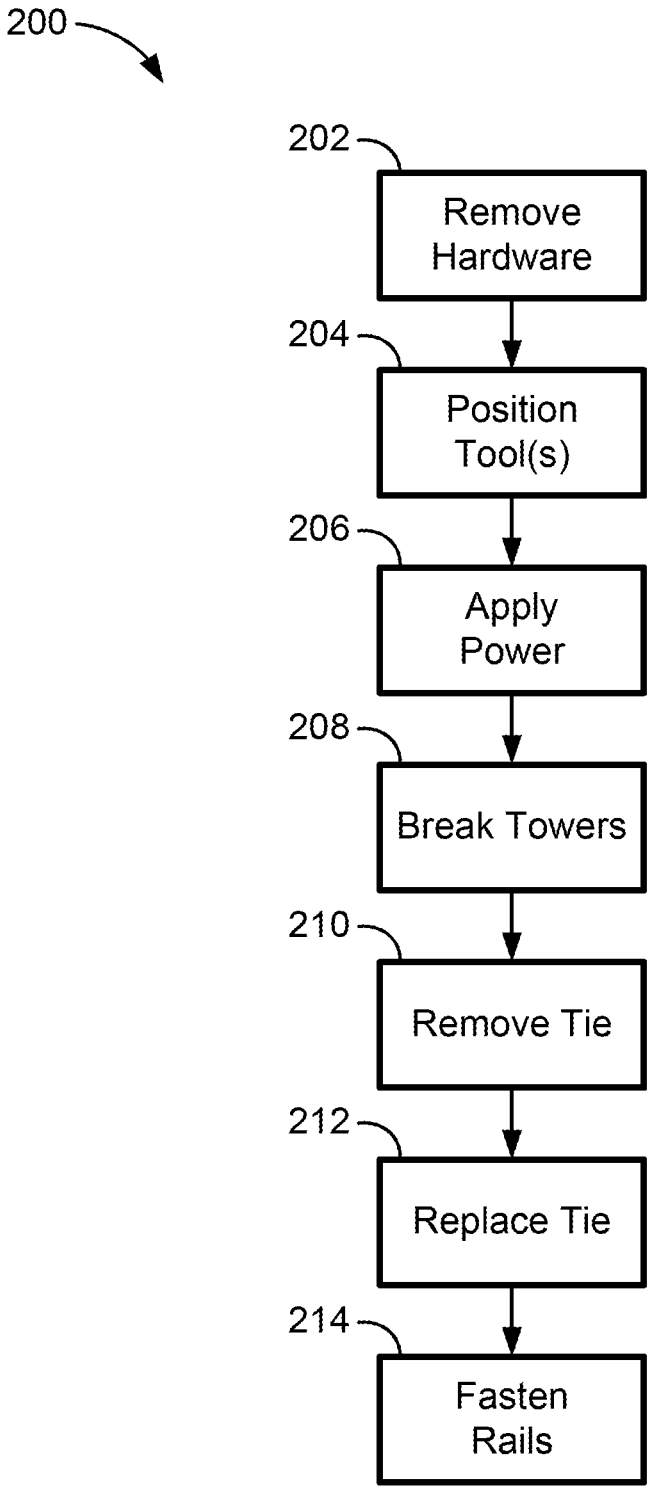
FIG. 8 is a schematic illustration of an embodiment of a process followed to remove the towers from the concrete tie of FIG. 1.

With reference now to FIG. 8, a general process 200 of removing towers 22 is schematically illustrated. Reference can also be made to FIGS. 1-7 for particular structural components used in the process 200. First, the clips 24 and other hardware are removed from the towers 22 at step 202. Next, the tools 42 are positioned relative to the towers 22 by transitioning one or both of the tool mechanisms 38, 40 from the stored position to the working position by applying hydraulic power to the actuators associated therewith. Then, power is applied to the tools 42 at step 206, causing the towers 22 to break the towers 22 free of the tie 10 at step 208. Then the tie 10 is removed from under the rails 12 at step 210. Finally, a new tie is positioned under the rails at step 212, and the rails 12 are again fastened thereto at step 214.

Removing the clips and other hardware at step 202 can occur manually, or can occur with the removal of the towers 22 at step 208. The tools 42 have enough power to break the towers 22 free of the tie 10 with or without the clips 24 in place. However, it is recognized that there is a reduced risk of damage to the rails 12 if the clips are first removed, and then the towers 22 are broken free of the tie 10.

Positioning the tools at step 204 can be done manually via a control manipulated by the operator, allowing the operator to govern the travel of the linear actuators of the tool mechanisms 38, 40. Alternatively, the tool mechanisms 38, 40 may be positioned automatically, for example upon depression of a button or switch, to increase repeatability of the desired position. The same is true for the application of power at step 206 to remove the towers 22.

As described herein, the tower removing apparatus provides a system and process that substantially reduces the time required to replace concrete ties. The tower removing apparatus accomplishes this by incorporating tools 42 that are aligned with the towers 22 of a railroad tie 10 in such a way as to completely remove the towers 22 from the tie 10.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A railroad tie hardware removing apparatus for removing mounting structures used to affix the rails of a railroad track to a concrete railroad tie, the railroad tie hardware removing apparatus comprising:

a frame configured for travel upon the rails of the railroad track;

at least one tool adapted to break the mounting structures;

at least one tool mechanism mounted to the frame, the at least one tool carried by the at least one tool mechanism; and wherein the at least one tool mechanism is operable to transition the at least one tool from a stored position wherein the at least one tool is spaced above the mounting structures, and a working position wherein the at least one tool is in contact with one of the mounting structures.

2. The apparatus of claim 1, wherein the frame includes rail wheels such that the frame is movable along the rails via the wheels.

3. A railroad tie hardware removing apparatus for removing mounting structures used to affix the rails of a railroad track to a concrete railroad tie, the railroad tie hardware removing apparatus comprising:

a frame configured for travel upon the rails of the railroad track;

at least one tool adapted to break the mounting structures;

at least one tool mechanism mounted to the frame, the at least one tool carried by the at least one tool mechanism;

wherein the at least one tool mechanism is operable to transition the at least one tool from a stored position wherein the at least one tool is spaced above the mounting structures, and a working position wherein the at least one tool is in contact with one of the mounting structures; and wherein the at least one tool mechanism includes a first and a second tool arm, and the at least one tool includes a first and a second tool carried, respectively, by the first and second tool arms, the first and second tool arms mechanically coupled at a first common mounting point to a mounting hub, and mechanically coupled to one another by a scissor mechanism.

4. The apparatus of claim 3, wherein the scissor mechanism includes a first scissor linkage connected at a first end thereof to the first tool arm, and a second scissor linkage connected at a first end thereof to the second tool arm, and wherein each of the first and second scissor mechanisms have second ends that are commonly mounted at a second common mounting point.

5. The apparatus of claim 4, wherein the second common mounting point is an end of a linear actuator.

6. The apparatus of claim 5, wherein the linear actuator is connected to a frame of the at least one tool mechanism at an end of the linear actuator opposite the end of the linear actuator providing the second common mounting point.

7. The apparatus of claim 6, wherein extension of the linear actuator moves the first and second tools from the stored position to the working position.

8. The apparatus of claim 7, wherein extension of the linear actuator moves the first and second tool arms simultaneously from the stored position to the working position and laterally away from one another.

9. The apparatus of claim 1, wherein a longitudinal axis of the at least one tool is at an angle of about forty-five degrees relative to the rails in the working position.

10. The apparatus of claim 9, wherein the longitudinal axis of the at least one tool is at an angle of about forty-five degrees relative to a top surface of the concrete railroad tie in the working position.

11. A method for removing a mounting structure used to affix a pair of rails of a railroad track to a concrete railroad tie, the method comprising:

positioning a frame carrying at least one tool mechanism over the mounting structure;

extending at least one tool carried by the at least one tool mechanism from a stored position to a working position, wherein in the working position the at least one tool contacts the mounting structure; and breaking the mounting structure by applying a force against the mounting structure at a selected orientation using the tool.

12. The method of claim 11, wherein positioning includes rolling the frame along the pair of rails using at least one pair of rail wheels mounted to the frame.

13. The method of claim 11, wherein extending includes simultaneously extending first and second tools connected to one another and to a linear actuator using a scissor mechanism.

14. The method of claim 11, wherein breaking the mounting structure includes applying a force at a selected orientation comprising an angle of about forty-five degrees between a longitudinal axis of the at least one tool and the pair of rails.

15. The method of claim 14, wherein breaking the mounting structure includes applying a force at a selected orientation comprising an angle of about forty-five degrees between the longitudinal axis of the at least one tool and a top surface of the concrete railroad tie.

* * * * *